United States Patent [19]

Dalziel

[11] 3,941,052

[45] Mar. 2, 1976

[54] PRINT HAMMER APPARATUS WITH ANGULARLY DISPOSED MATING HAMMER AND POLE FACES TO PREVENT CONTACT BOUNCE

[75] Inventor: Warren L. Dalziel, Monte Sereno, Calif.

[73] Assignee: Shugart Associates, Inc., Sunnyvale, Calif.

[22] Filed: Apr. 29, 1974

[21] Appl. No.: 464,851

[52] U.S. Cl. ..... 101/93.48; 101/93.02

[51] Int. Cl.[2] ..... B41J 9/42

[58] Field of Search ..... 101/11, 93.02, 93.14, 93.29–93.39, 101/93.48

[56] References Cited

UNITED STATES PATENTS

| | | | |
|---|---|---|---|
| 3,335,659 | 8/1967 | Schacht et al. | 101/93.02 |
| 3,416,442 | 12/1968 | Brown et al. | 101/93.14 |
| 3,741,110 | 6/1973 | Bossi | 101/93.14 |
| 3,749,008 | 7/1973 | Carlson et al. | 101/93.14 |

*Primary Examiner*—Edgar S. Burr
*Assistant Examiner*—Edward M. Coven
*Attorney, Agent, or Firm*—Schatzel & Hamrick

[57] ABSTRACT

A print hammer apparatus is disclosed which comprises a resilient member having a fixed end and a movable end, the movable end being movable between a cocked position and a striking position, a hammer affixed to the movable end and carried thereby over an arcuate path between the cocked position and the striking position, the hammer including an impact head at one end and a flag member at the other end, the flag member being of magnetic material and having a flag face with a surface which is at all points angularly disposed at an angle other than normal to the path, a stator pole piece having a pole face which matingly corresponds to the flag face, a magnetic side pole disposed laterally of the path, a permanent magnet coupled to the pole piece and to the side pole and operative to develop a magnetic force for causing the hammer to move against the influence of the resilient member and into the cocked position with the flag face engaging the pole face, and a coil disposed on the pole piece for momentarily developing a magnetic flux in opposition to the flux developed by the permanent magnet, thereby reducing the magnetic force and allowing the hammer to move along the path into the striking position under the influence of the resilient member, the resilient member being operative to thereafter return the hammer along the path to the cocked position whereby the flag face impacts the pole face and whereby the interaction of the angularly engaging faces and the magnetic relationships between the pole piece, the flag member and the side pole cause the hammer to experience substantially no contact bounce.

14 Claims, 15 Drawing Figures

PRINT HAMMER APPARATUS WITH ANGULARLY DISPOSED MATING HAMMER AND POLE FACES TO PREVENT CONTACT BOUNCE

BACKGROUND OF THE INVENTION

1. Field of the Invention

This invention relates to a print hammer apparatus for use in printers which operate with a data processing system and, more particularly, to such hammer apparatus which includes a magnetic flag member which has a flag face that is angularly disposed to the path traversed by the hammer and a stator pole piece that has a pole face that matingly corresponds to the shape of the flag face such that contact bounce is eliminated when the flat face impacts the pole face.

2. Description of the Prior Art

In printers of the type used in data processing equipment, a movable belt supporting a plurality of type characters is moved continuously past a print line at a constant rate of speed. A print medium, such as a web of paper, is fed incrementally, step by step, past the print line, and an aligned array of print hammers is arranged for impact printing along the print line. Because of the relative movement between the type characters on the belt and the print medium during printing, it will be appreciated that the time of printing and, correspondingly, the time of flight taken by the respective print hammers in moving from a cocked position to a striking position and back again must be extremely short to achieve an adequate printing rate, most importantly, must be precisely the same during all strike cycles to assure predictable results. In order to decrease data processing costs, data processing installations are desirous of obtaining printers which exhibit good print quality, require low maintenance, and are lower in cost.

One technique of lowering printer cost is to decrease the cost of the print hammer assembly by reducing the number of individual print hammers, since the hammer assemblies comprise a substantial portion of the total printer cost. Thus, print hammer assemblies which span several type face positions have been fabricated. One example of such a hammer assembly is disclosed in U.S. Pat. No. 3,460,469, entitled "Print Hammer Actuator", and issued on Aug. 12, 1969, in the names of E. A. Brown, R. H. Darling and A. S. Chou. As disclosed therein, the print hammer actuator comprises a magnetic core structure comprising two off-set pole pieces which are formed to define a substantially closed path. A resilient actuator member is mounted with one end fixed relative to the magnetic core structure. A movable magnetic core member is attached to one side of the other end of the actuator member at a position so that the generation of a magnetic flux within the magnetic core structure attracts the movable member, and causes the actuator to be attracted to the pole piece and held thereat in a cocked position. A winding is provided for selective energization to release the movable magnetic member to enable a hammer positioned on the other side of the movable magnetic member to strike a type character. After striking the character the movable magnetic member rebounds off the type and is once again attracted to the pole piece. It will be appreciated that as the resilient member rebounds from the type and moves under the magnetic force of attraction to the pole piece, it acquires a substantial amount of kinetic energy. This kinetic energy causes the movable magnetic member to bounce off the pole piece as it returns to the cocked position.

It must be borne in mind that the hammer bounce problem seriously affects the recycling frequency of the hammer. After a bounce the hammer is positioned some distance from the pole face. Accordingly, before the hammer can be recycled and fired again, it must first be recaptured. It follows that the sum of the flight time and the recapture time determines the recycling frequency of print hammer actuation.

In order to decrease the recycle time, it is necessary to minimize, or eliminate, the time required to recapture the print hammer. Heretofore, attempts to minimize the recapture time have been unsuccessful. First, a visco-elastic damping technique was attempted in which a rubber bumper was secured so as to control the movable member. However, that technique merely increased the initial spring force but did not control recapture. In a second attempt, lubricating oil was applied to the contacting surface of the pole piece and the magnetic member with the hopes that the increase in the viscous forces therebetween would serve to prevent bounce. However, this attempt failed since the dynamic forces at the contacting surfaces was too high. An electrical damping technique was next attempted in which the current in the release winding was reversed at predetermined time. However, the complexity of controlling the required timing of the current reversals in view of the unstable and unpredictable nature of the bounce times, especially when a bank of print hammers was attempted to be controlled, caused this technique to be discarded.

Examples of prior art print hammer assemblies can be found in U.S. Pat. No. 3,349,696, entitled "Hammer Module Assembly in High-speed Printers," which issued Oct. 31, 1967, in the name of John T. Potter; U.S. Pat. No. 3,592,322, entitled "Wire Printing Head," which issued on July 13, 1971, in the names of A. S. Chou and E. A. Brown; and U.S. Pat. No. 3,656,425, entitled "Electromagnetic Actuating Means for Print Hammer," which issued Apr. 18, 1972, in the names of R. T. Albo and J. Pastroni.

OBJECTS OF THE INVENTION

It is therefore an object of the present invention to provide a print hammer assembly which does not exhibit contact bounce.

Another object of the present invention is to provide a print hammer assembly which effectively recaptures a resilient spring member on its return to a cocked position without producing appreciable wear between the flag member and the magnetic core.

Still another object of the present invention is to provide a print hammer assembly that has a recycle firing period of less than 1.2 milliseconds with a given stroke.

Still another object of the present invention is to eliminate contact bounce in a print hammer apparatus by selectively shaping the flag face and the pole face.

Still another object of the present invention is to provide a novel adjustment mechanism for controlling the forward-flight time of the hammer assembly as it moves from the cocked position to the striking position.

SUMMARY OF THE INVENTION

In accordance with the present invention a print hammer apparatus is provided which includes a resilient member having a fixed end and a movable end, the movable end being movable between a cocked position and a striking position, hammer means affixed to the movable end and carried thereby over an arcuate path between the cocked position and the striking position, the hammer means including an impact head at one end a flag member at the other end, the flag member being of magnetic material and having a flag face with a surface which is at all points angularly disposed at an angle other than normal to the path, the stator pole piece having the pole face, the pole face matingly corresponding to the flag face, side pole means disposed laterally of the path, magnetic flux generating means coupled to the pole piece and to the side pole means and operative to develop a magnetic force for causing the hammer means to move against the influence of the resilient member and into the cocked position with the flag face engaging the pole face, the flag member and the side pole means forming the magnetic flux circuit for the flux generated by the generating means, and electromagnetic means disposed along the circuit for momentarily developing magnetic flux in opposition to the flux developed in the circuit by the generating means, thereby reducing the magnetic force and allowing the hammer to move along the path into the striking position under the influence of the resilient member, the resilient member being operative to thereafter return the hammer means along the path to the cocked position whereby the flag face impacts the pole face and whereby the interaction of the angular engaging faces and the magnetic relationships between the pole piece, the flag member and the side pole means cause the hammer means to experience substantially no contact bounce. In the preferred embodiment, the flag face is planar and is disposed transversely to the path described by the hammer at an angle between 10° and 40°. Another feature of the print hammer apparatus is a novel clamping means for adjusting the neutral position of the resilient member such that the flight time of the hammer can be precisely controlled.

Among the advantages of the present invention is that no contact bounce is exhibited when the flag face strikes the pole face as the hammer transitions from its striking position to its cocked position.

Another advantage of the present invention is that recycle periods of about 1.2 milliseconds are obtained.

Another advantage of the present invention is that flight times of the hammer apparatus are accurately controlled with a simple clamp and adjustable set screw configuration.

Other objects and advantages will be apparent to those skilled in the art after having read the following detailed disclosure which makes reference to the several figures of the drawings.

IN THE DRAWINGS

DETAILED DESCRIPTION OF THE PREFERRED EMBODIMENT

Figure 1:
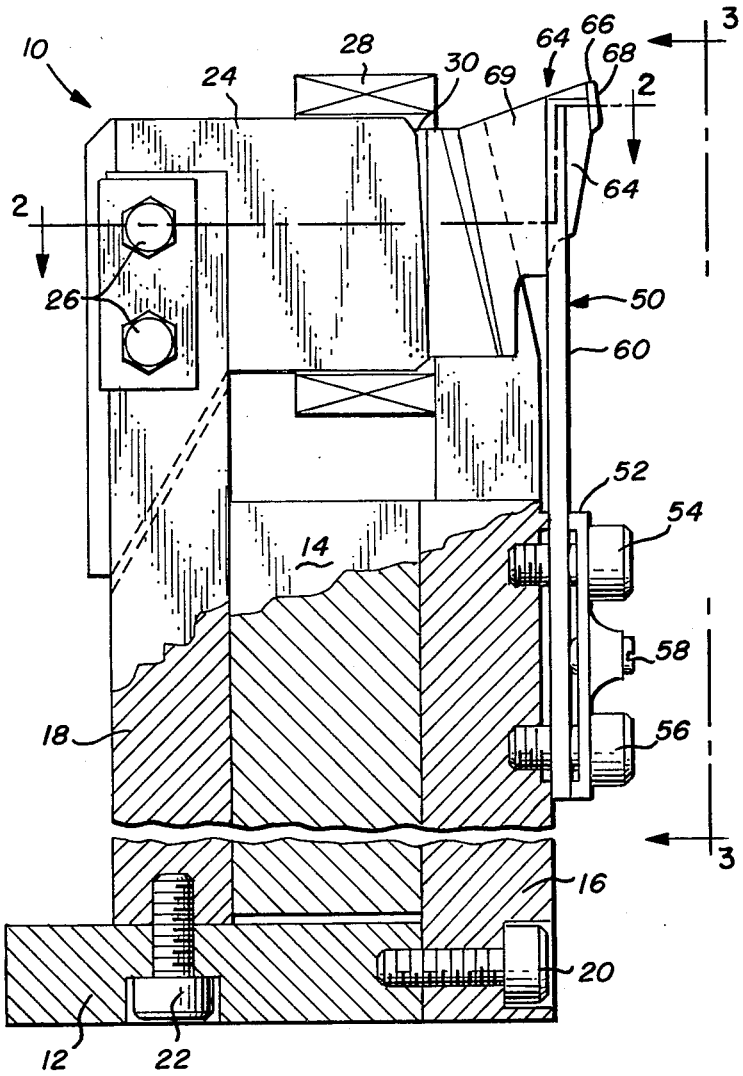
FIG. 1 is a side elevational view of the print hammer apparatus in accordance with the present invention with portions shown in section for clarity.

Referring now to the drawings and in particular to FIG. 1 thereof, the print hammer apparatus, generally designated by the numeral 10, is illustrated. The print hammer apparatus includes a base plate 12 made of a material having a very low magnetic permeability. Supported above the base plate 12 is an elongated permanent magnet 14 made of a strong magnetic material such as the ceramic, barium ferrite. Front and rear pole pieces 16 and 18 are juxtaposed against opposite faces of the magnet 14 and secured thereagainst in an abutting relationship with the magnet 14 and the base plate 12 by screws 20 and 22. A stator pole piece 24 abuts the rear pole piece 18 and is secured thereto by a pair of adjusting screws 26 in a position extending over the permanenet magnet 14 toward the front pole piece 16. A coil of wire 28 is wound around the stator pole piece 24 near its pole face 30.

Figure 3:
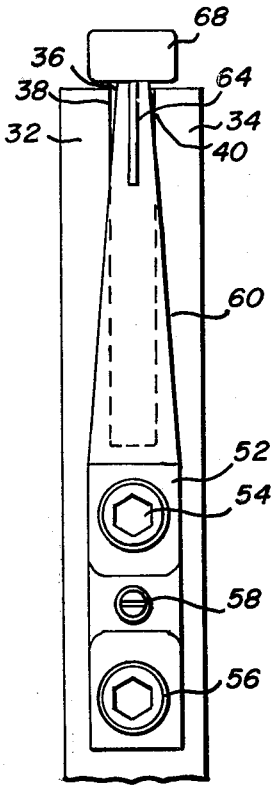
FIG. 3 is a side elevational view of a portion of the print hammer apparatus of FIG. 1 illustrating the resilient member and the clamp assembly for adjusting the flight time of the print hammer.
Figure 2:
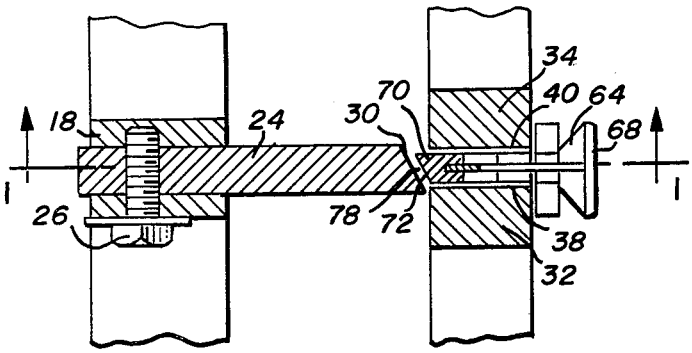
FIG. 2 is a sectional view taken through the lines 2—2 of FIG. 1.

Referring to FIGS. 2 and 3, the front pole piece 16 includes a bifurcated upper portion which defines a pair of spaced-apart side poles 32 and 34. The poles 32 and 34 are separated by a slot 36 so as to form facing pole faces 38 and 40, respectively, which are parallel to and spaced apart a distance slightly less than that between the side faces of the stator pole piece 24.

A print hammer 50 is affixed to the front pole piece 16 in alignment with the slot 36 by a clamping plate 52 and screws 54 and 56. The print hammer 50 includes a resilient member 60 having one end fixed by the clamping plate 52 and a movable end that is necked down and movable toward the pole face 30. The resilient member 60 is preferably a flat leaf spring. The neutral position of the spring 60 is adjustable by selectively turning a set screw 58 associated with the clamping plate 52. Affixed to the movable end of the resilient member 60 is a hammer means, generally designated by the numeral 64 which is carried by the resilient member in an arcuate path between a cocked position and a striking position. The hammer means 64 includes an impact head 66, or anvil which is preferably integrally formed with the spring and includes an impact face 68 for striking type characters (not shown) as they move past the hammer apparatus. A support 69 is secured to the resilient member 60 opposite the impact head and facing the pole piece 24, and a flag member 70 is affixed thereto. The flag member 70 is fabricated from a magnetic material which preferably has a high permeability. The outermost surface of the flag member 70 defines a flag face 72.

Figure 5:
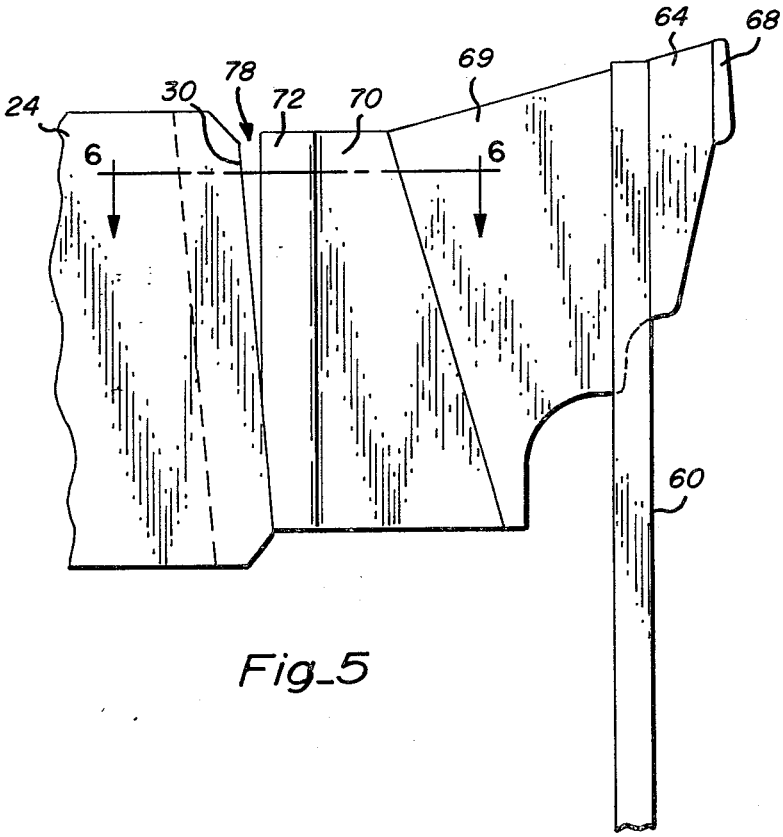
FIG. 5 is an elevational view of the hammer means and the stator pole piece illustrating the mating relationship between the flag face and the pole face.
Figure 6:
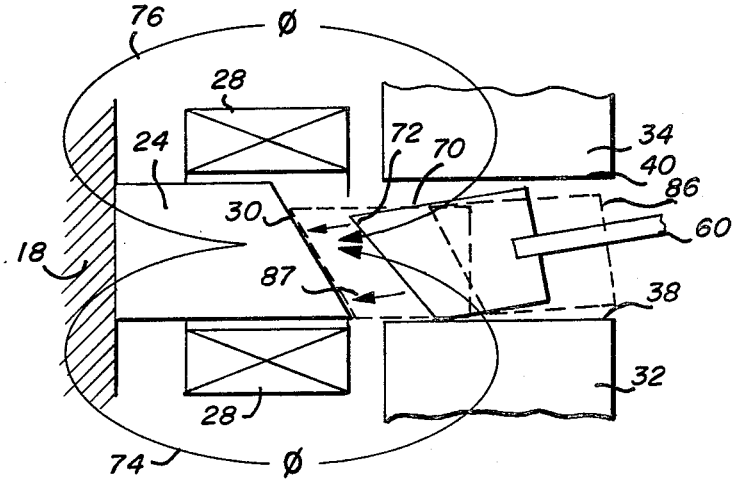
FIG. 6 is a sectional view taken through the lines 6—6 of FIG. 5 illustrating the position of the flag member prior to and at the time of recapture.

In accordance with the present invention the flag face 72 defines a surface which is at all points angularly disposed at an angle other than normal to the path traversed by the hammer means 62, and the pole face 30 defines a surface that matingly corresponds to that of the flag face. It has been found that with this relationship between the faces, contact bounce is eliminated. In the preferred embodiment, as illustrated in FIGS. 2, 5 and 6, the flag face is planar and is disposed transverse to the path.

Figure 7:
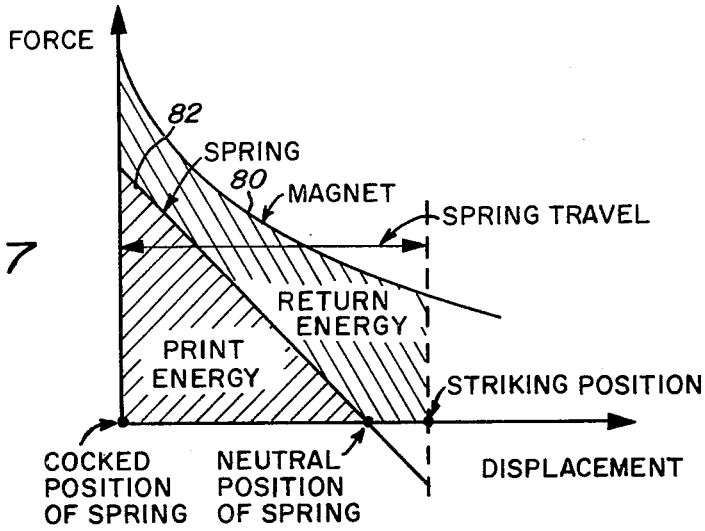
FIG. 7 is a graph of force versus displacement for the magnet and the resilient member which also illustrates the energy contributions by the several components of the print hammer apparatus of the present invention.

It will be realized by those skilled in the art that the permanent magnet 14 provides a magnetic flux generating means which generates a continuous magnetic flux, $\phi$, of constant magnitude through a magnetic circuit comprising the rear pole piece 18, the stator pole piece 24, the flag member 70, the side pole pieces 32 and 34, and the front pole piece 16. The flux paths $\phi$ are best illustrated in FIG. 6 and are designated by the numerals 74 and 76. Two paths are shown since the magnetic circuit comprises parallel branches through the offset side pole pieces 32 and 34. The spacing between the flag face 72 and the pole face 30 is referred to as the gap 78. The gap 78 provides a region of high intensity magnetic fields which are in a direction normal to the angularly disposed flag face 72, one component of which attracts the flag member 70 toward the stator pole piece 24. The magnetic forces of attraction accordingly causes the resilient member 60 to bend from its neutral position until the flag face 72 engages the pole face 30. When the faces are so engaged the hammer is considered to be in the cocked position. The operation of the apparatus will hereafter be described with reference to FIGS. 6, 7 and 8. With reference to FIG. 7, a force versus displacement graph is illustrated. The curve 80 illustrates the magnetic force in the gap 78 due to the permanent magnet 14. The magnetic force is proportional to the inverse of the distance squared that the flag face is from the pole face. The curve 82 illustrates the spring force and is shown to be directly proportional to the displacement of the flag member. It should be noted that at the neutral, or unbiased, position of the spring the force is zero and that when the spring is in the striking position the spring force is negative. In addition, the magnitude of the magnetic force is always greater than the spring force. Consequently, when the spring is in the cocked position the magnetic force of attraction is greater than the spring force tending to restore the spring to its neutral position.

An energy diagram is superimposed upon the force graph and the print energy is illustrated by the cross-hatched portion bounded by the spring force curve and the force and displacement axes. The return energy is proportional to the area enclosed above the spring force curve and under the permanent magnet force curve 80.

Figure 8:
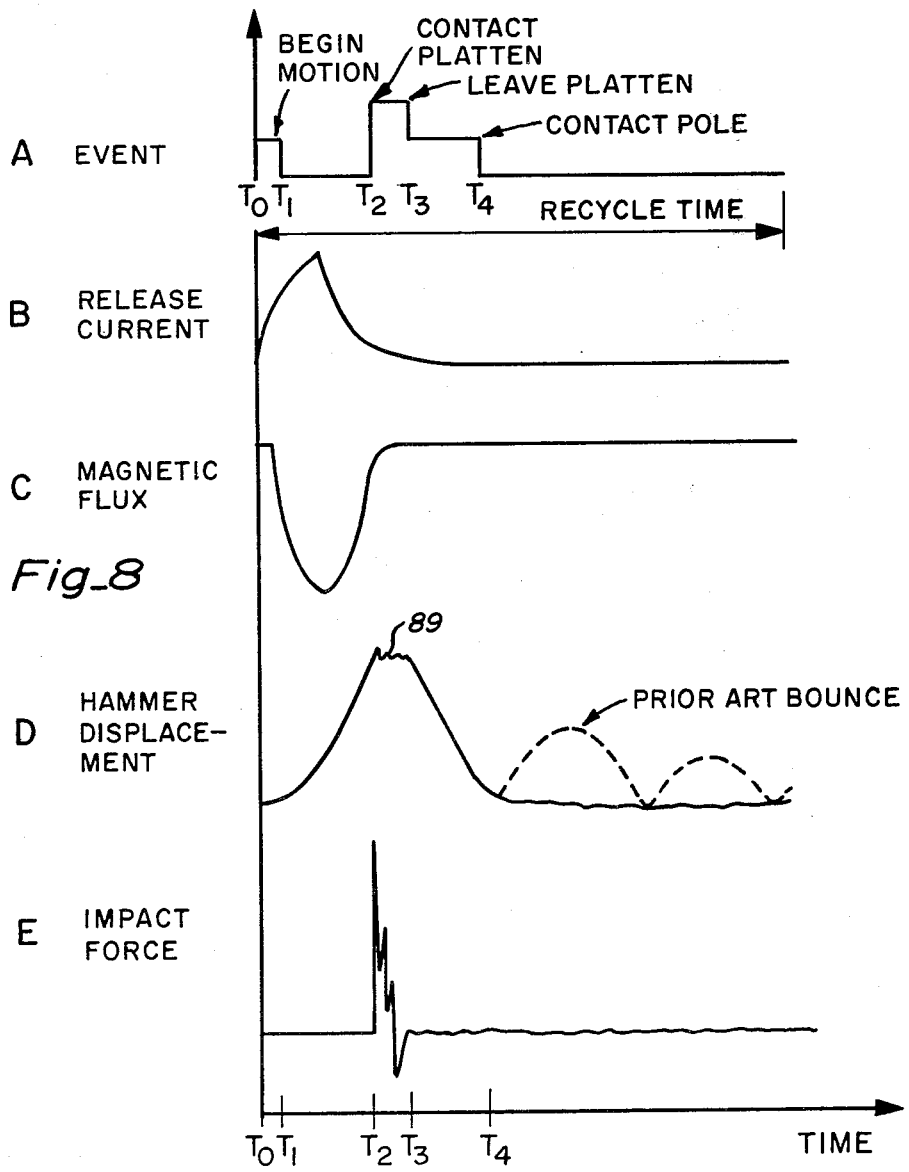
FIGS. 8A through 8E are timing diagrams illustrating the time variation of several important parameters and events over a cycle of operation of the present invention.

Referring to FIG. 8, at time $T_0$, a release current is applied through the coil 28 which is of a magnitude and direction to cause a bucking magnetic flux to be generated. The release current is illustrated in FIG. 8B and the bucking magnetic flux is illustrated in FIG. 8C. The bucking magnetic flux is produced in a direction in opposition to the flux developed by the permanent magnet. This opposition flux reduces the magnetic force of attraction between the pole face and the flag member, and allows the hammer to move into a striking position under the influence of the energy stored in the cocked resilient member. In the striking position, as illustrated in FIG. 8A, the print impact head 66 strikes the type character or platen (not shown) at time $T_2$. Hammer displacement is shown in FIG. 8D and the impact force on the platen is illustrated in FIG. 8E. The impact head remains against the type character as shown at 89 for a contact interval until the time $T_3$. After the contact interval, at time $T_3$, the impact head rebounds from the platen under the influence of the reactive forces caused by the striking and the return force caused by the magnet and returns along the arcuate path toward the cocked position. In FIG. 6, the dashed lines 86 illustrate the position of the flag member 70 as it rebounds from the platen. As illustrated the flag member 70 is substantially equally spaced from the pole faces 38 and 40. The flag member experiences a force normal to the flag face 72 and is deflected towards the side pole 32. The amount of deflection is determined by the stiffness of the support 69 and the spring 60. With the correct stiffness and spacing between the flag 70 and the side pole 32, the flag 70 will contact the pole face 38 prior to reaching the cocked position. This position is represented by the solid lines of FIG. 6. As the flag 70 is deflected toward the pole face 38, the flux increases on the contacting side of the flag. This increasing flux causes an additional force tending to bring the flag 70 and side face 38 into contact. As a consequence of these forces, the side surface of the flag member frictionally contacts and rubs against the pole face 38 thereby converting some of the kinetic energy of the moving hammer into heat which is easily dissipated. At time $T_4$ the flag face 72 contacts the pole face 30. This impact causes a small amount of sliding between the inclined surfaces. This small motion occuring under the influence of the large impact forces, dissipates the remaining kinetic energy and hence the hammer assembly stops without leaving the stator pole face 30.

As illustrated by the dashed lines of FIG. 8D, because of the normal relationship between the flag face and the pole faces relative to the path of travel in prior art print hammers, substantial bounce occurred whereby the flag member was not recaptured against the pole face. In some high friction instances the flag member remained permanently spaced from the pole face and consequently was caused to refire against the platen from a different position.

In accordance with the present invention, the introduction of an angled flag face relative to the path of the hammer alters the return path of the flag such that the return kinetic energy associated with the hammer is less than the energy dissipated in the side poles due to sliding friction, the frictional energy dissipated in the pole piece 24 by sliding friction and the sundry energies associated with recapture, noise, local deformation and heat. With reference again to the time $T_4$, the position of the hammer is illustrated by the dashed lines at 87 in FIG. 6, and in FIG. 8D as being adjacent the pole face 30. It has been observed with electronic instrumentation that at times just after contact, the flag face slides along the pole face 30 toward the side pole 34 but does not bounce away from the in-contact condition. Accordingly, the hammer has been effectively recaptured by the pole face and is ready to be refired from its cocked position.

An additional advantage of the angled flag face is that the gap is always less than a given stroke. Therefore, more magnetic force is developed at a given stroke. In some applications, this may allow the use of a smaller magnet or a reduction in the hammer mass.

It has been found that when the angle that the flag face makes with an axis that is normal to its path increases past a certain angle, the initial value of the permanent magnet force curve 80 decreases so as to have an initial value that is less than that of the spring, when the spring, as represented by curve 82, is in the cocked position. Experimentation has shown that angles between 10° and 40° can be used. It is believed that angles outside these limits may also be used.

Figure 4:
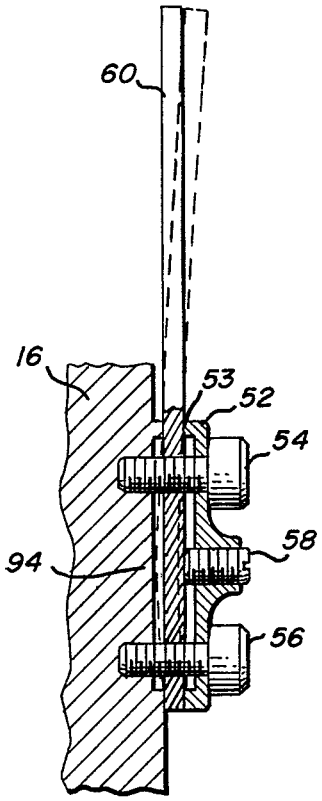
FIG. 4 is a side elevational sectional view of the resilient member and the clamp assembly with an adjusted position of the resilient member shown in phantom.
Figure 9:
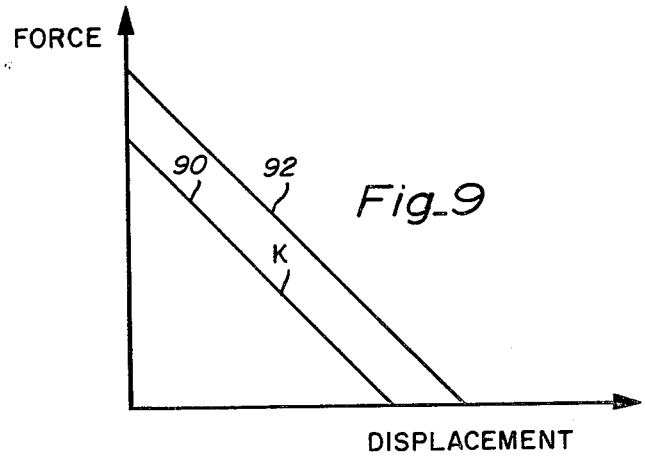
FIG. 9 is a graph illustrating the force versus displacement of the resilient spring member of the apparatus of the present invention depicting the flight time adjustment feature.

Referring now to FIGS. 4 and 9, another feature of the present invention is shown. This feature includes novel means for effecting an adjustment of the flight time of the print hammer by adjusting the neutral position of the spring. It should be recognized that the greater the displacement of the resilient member or spring 60 from its neutral position when it is in the cocked position then the greater is the spring energy that is stored. The curve 90 in FIG. 9 illustrates the force versus displacement characteristic of a spring having a fixed neutral position. The slope of the curve is designated by the numeral K and is a constant associated with the geometry and materials of the spring. By experimentation, it has been found that it is very difficult to predict the effect that changes in the geometry will have on the spring constant K. In addition, it is very difficult to cock all springs exactly the same amount. Thus, in accordance with this invention, a set screw 58 is inserted between the screws 54 and 56 so that it contacts the resilient member 60. As the screw 58 is turned in the spring deforms and is forced into another neutral position illustrated be the dashed lines in FIG. 4. For example, displacing the set screw 58 inwardly toward the pole piece 16 causes the neutral position of the spring to move closer toward the striking position, thereby causing the resilient member to store more potential energy when it is forced into the cocked position. Accordingly, the forward flight time will decrease. Curve 92 represents the force characteristic of this condition. Deformations of about 0.020 inches can be achieved with the set screw arrangement. To provide for the deformation, the front pole piece 16 which receives the clamp plate 52 is recessed as at 94. In addition, the surface 53 of the clamp plate is machined so as to provide a fixed pivot point so that the effective length of the resilient member 60 remains fixed for all flight time adjustments.

Figure 10:
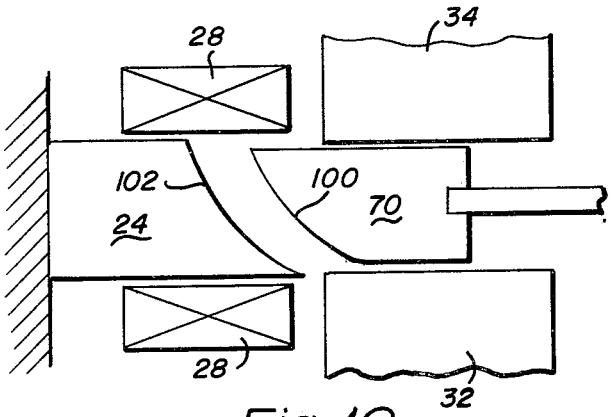
FIGS. 10 and 11 are views similar to that of FIG. 6 illlustrating several alternative embodiments of the present invention.
Figure 11:
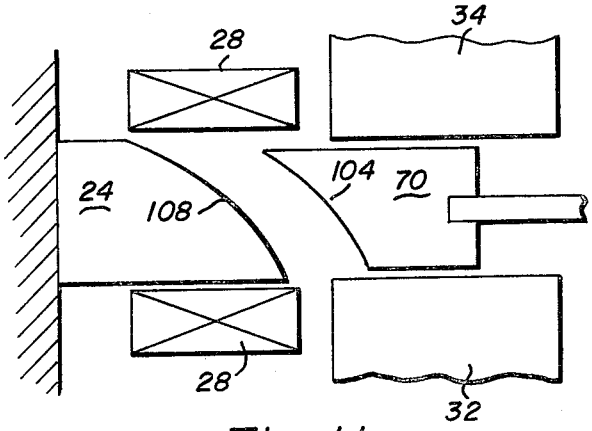

Referring now to FIGS. 10 and 11, several alternative embodiments of the flag member and the pole face are illustrated. In FIG. 10 the flag face 100 has a convex parabolic shape. Similarly, the pole face 102 is defined by a mating concave parabolic surface. In FIG. 11, the flag face 104 has a concave parabolic shape and the pole face 108 has a mating convex parabolic shape.

In a specific embodiment of the print hammer apparatus comprising the present invention, a character belt is moved at a rate of 85 inches per second past a bank of hammers, each hammer having a width of about 0.290 inches. The flag face is planar, disposed at an angle of 20° to normal, and mates with a pole face that is also disposed at an angle of 20°. The recycle time required for the print hammer to move from the cocked position to the striking position and back to the cocked position is 1.2 milliseconds. Dual side pole pieces 32 and 34 are used to double the area through which the magnetic flux flows, thereby increasing the magnetic field in the gap 72. The increased magnetic field advantageously allows a hammer of reduced mass to be used.

From the above, it will be seen that there has been provided an improved print hammer apparatus which fulfills all of the objects and advantages set forth above.

While there has been described what are at present considered to be the preferred embodiments of the invention, it will be understood that various modifications may be made therein, and it is intended to cover in the appended claims all such modifications as fall within the true spirit and scope of the invention.

What is claimed is:

1. Print hammer apparatus comprising:

a resilient member having a fixed end and a movable end, said movable end being movable between a cocked position and a striking position;

hammer means affixed to said movable end and carried thereby over an arcuate path between said cocked position and said striking position, said hammer means including an impact head and a flag member, said flag member being of magnetic material and having a flag face with a surface which is at all points angularly disposed at an angle other than normal to said path;

a stator pole piece disposed in alignment with said path and having an angularly disposed pole face for matingly engaging said flag face;

side pole means disposed laterally of said path between said pole piece and said striking position, said side pole means and said pole piece forming a magnetic flux circuit;

magnetic flux generating means coupled to said pole piece and to said side pole means for generating magnetic flux through said circuit and operative to develop a magnetic force for causing said hammer means to move against the influence of said resilient member and into said cocked position with said flag face engaging said pole face; and electromagnetic means disposed along said circuit for momentarily developing magnetic flux in opposition to the flux developed in said circuit by said generating means thereby reducing said magnetic force and allowing said hammer to move along said path into said striking psoition under the influence of said resilient member, said resilient member and said generating means being operative to thereafter cause said hammer means to be returned along said path to said cocked position where said flag face impacts said pole face and whereby the interaction of said engaging faces and said side pole means and the magnetic relationships between said pole piece, said flag member and said side pole means causes said hammer means to experience substantially no contact bounce.

2. Print hammer apparatus as recited in claim 1 wherein said surface of said flag face is planar.

3. Print hammer apparatus as recited in claim 2 wherein said flag face lies in a plane which transversely intersects said path at an angle of between 10° and 40°.

4. Print hammer apparatus comprising:

a resilient member having a fixed end and a movable end, said movable end being movable between a cocked position and a striking position;

hammer means affixed to said movable end and carried thereby over an arcuate path between said cocked position and a striking position;

hammer means affixed to said movable end and carried thereby over an arcuate path between said cocked position and said striking position, said hammer means including an impact head and a flag member, said flag member being of magnetic material and having a first and a second side surface and a flag face with a surface which is at all points angularly disposed at an angle other than normal to said path which is at an obtuse angle relative to said first side surface;

a stator pole piece disposed in alignment with said path and having a pole face with a surface for matingly engaging said flag face;

a pair of side poles disposed opposite one another on each side of said path and respectively facing said side surfaces, said side poles and said pole piece forming a magnetic flux circuit;

magnetic flux generating means coupled to said pole piece and to said side poles for generating magnetic flux through said circuit and operative to develop a magnetic force for causing said hammer means to move against the influence of said resilient member and into said cocked position with said flag face engaging said pole face; and electromagnetic means disposed along said circuit for momentarily developing magnetic flux in opposition to the flux developed in said circuit by said generating means thereby reducing said magnetic force and allowing said hammer to move along said path into said striking position under the influence of said resilient member, said generating means being operative to thereafter cause said hammer means to be returned along said path to said cocked position, whereby said first side surface frictionally engages said first side pole as said hammer means returns and said flag face then impacts said pole face, the interaction of the angularly engaging faces and the magnetic relationships between said pole piece, said flag member and said side poles causing said hammer means to experience substantially no contact bounce.

5. Print hammer apparatus as recited in claim 4 wherein said surface of said flag face is parabolically curved in the transverse horizontal direction.

6. Print hammer apparatus as recited in claim 4 wherein said surface of said flag face is concave in the transverse horizontal direction.

7. Print hammer apparatus as recited in claim 4 wherein said surface of said flag face is convex in the transverse horizontal direction.

8. Print hammer apparatus as recited in claim 4 wherein said pair of side poles are separated by a distance slightly larger than the transverse width of said flag member, the transverse width of said stator pole piece being slightly larger than said distance.

9. Print hammer apparatus as recited in claim 4 wherein said surface of said flag face is planar.

10. Print hammer apparatus as recited in claim 9 wherein said flag face lies on a plane which transversely intersects such path at an angle of between 10° and 40°.

11. Print hammer apparatus as recited in claim 4 including means for selectively adjustiing the position of said resilient member so as to control the forward flight time required for said resilient member to move between said cocked position and said striking position.

12. Print hammer apparatus as recited in claim 11 wherein said position adjusting means includes a clamping means having a pair of spaced apart clamping surfaces for clampingly engaging different places along the length of said resilient member, and deforming means for selectively bowing the length of said resilient member disposed between said clamping surfaces causing the unrestricted position of said movable end to be selectively positionable along said path.

13. Print hammer apparatus as recited in claim 12 wherein said deforming means includes a threaded aperture in said clamping means and a set screw which when advanced through said aperture engages and deforms said resilient member.

14. Print hammer apparatus as recited in claim 13 wherein said position adjusting means is secured to said first side pole, the surface of said first side pole being recessed opposite said set screw for accommodating deformation of said resilient member in response to movement of said set screw.

* * * * *

UNITED STATES PATENT OFFICE

CERTIFICATE OF CORRECTION

Patent No. 3,941,052 Dated March 2, 1976

Inventor(s) Warren L. Dalziel

It is certified that error appears in the above-identified patent and that said Letters Patent are hereby corrected as shown below:

Column 1, line 18, "flat" should read --flag--;

Column 2, line 37, "3,592,322" should read --3,592,311--;

Column 7, line 36, "be" should read --by--;

Column 8, line 47, "psoition" should read --position--;

Column 10, line 19, "such" should read --said--;

Column 10, line 32, "unrestricted" should read --unrestrained--.

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*